US005152205A

United States Patent [19]

Yoshida et al.

[11] Patent Number: 5,152,205

[45] Date of Patent: Oct. 6, 1992

[54] ROTARY SHEAR

[75] Inventors: Makoto Yoshida; Makoto Ando, both of Mihara, Japan

[73] Assignee: Mitsubishi Jukogyo Kabushiki Kaisha, Tokyo, Japan

[21] Appl. No.: 735,916

[22] Filed: Jul. 25, 1991

[30] Foreign Application Priority Data

Jul. 26, 1990 [JP] Japan ..... 2-78767[U]

[51] Int. Cl.[5] ..... B26D 1/62

[52] U.S. Cl. ..... 83/304; 83/349; 83/658

[58] Field of Search ..... 83/304, 305, 349, 658, 83/332, 663, 508, 639.5

[56] References Cited

U.S. PATENT DOCUMENTS

| | | | |
|---|---|---|---|
| 2,369,253 | 2/1945 | Robinson et al. | 83/304 X |
| 2,733,766 | 2/1956 | Wikle | 83/658 X |
| 3,491,632 | 1/1970 | Dovey | 83/332 X |
| 3,522,762 | 8/1970 | Sauer . | |

FOREIGN PATENT DOCUMENTS

| | | |
|---|---|---|
| 2414986 | 1/1975 | France . |
| 1014592 | 12/1965 | United Kingdom . |
| 2103139 | 7/1982 | United Kingdom . |

*Primary Examiner*—Frank T. Yost
*Assistant Examiner*—Rinaldi Rada
*Attorney, Agent, or Firm*—Rothwell, Figg, Ernst & Kurz

[57] ABSTRACT

An improved rotary shear for performing slotting work or cutting work upon a corrugated cardboard web at right angles to its traveling direction for making order change easy and smooth, is disclosed. The rotary shear comprises a knife cylinder having a knife fixedly secured thereto over the nearly entire width of its outer circumferential surface, pressing means divided into a plurality of sections along the widthwise direction of the corrugated cardboard web and constructed in such manner that the respective sections can be individually raised and lowered, and an endless elastic body belt driven to travel at a predetermined timing with respect to the traveling corrugated cardboard web.

5 Claims, 4 Drawing Sheets

ROTARY SHEAR

BACKGROUND OF THE INVENTION

1. Field of the Invention:

The present invention relates to a rotary shear installed in a corrugating machine for performing slotting work or cutting work upon a continuously traveling corrugated cardboard web nearly at right angles thereto.

2. Description of the Prior Art:

One example of a rotary shear in the prior art is illustrated in FIGS. 4 to 7. The rotary shear is an apparatus for cutting a corrugated cardboard web 17 which has been manufactured continuously in a corrugating machine or performing slotting work thereto along the widthwise direction of the web. The prior art rotary shear mainly operates at the time of order change and it functions to deal with switching of setting such as width change of trims 21*a* and 21*b* or sheet 21*a–e*.

A description of the general construction and function of a rotary shear in the prior art will be disclosed as follows. As shown in FIGS. 4(*a*) and (*b*), a knife cylinder 2 having a knife 1 fixedly secured thereto has its opposite ends pivotably supported from frames 4*a* and 4*b*, resting on floor FL, erected at the opposite width ends of the apparatus via bearings 3*a* and 3*b*, respectively. A shaft 6 is connected via an electromagnetic clutch brake 5 to an outer most end of the knife cylinder 2. A pulley 7 is mounted to shaft 6 which is coupled to a pulley 10 fixedly secured to a line shaft 8 or a shaft 8 of a motor 9 serving as an independent drive unit, via an endless synchronizing bell 11 wound therearound.

As further shown in FIGS. 4(*a*) and (*b*), an anvil cylinder 22 has its opposite ends pivotably supported from the frames 4*a* and 4*b*, respectively, via bearings 23*a* and 23*b* in parallel to the above-described knife cylinder 2. To one end of the anvil cylinder 22 is fixedly secured a pulley 24, which is coupled to a pulley 27 on a shaft 26 pivotably supported from the frame 4*a* via a belt 25. In addition, the above-mentioned shaft 26 is connected to an indexing motor 29 via an electromagnetic clutch brake 28. Reference numeral 12 designates an endless elastic body belt, which comes into slide contact with the outer circumferential surfaces of the knife cylinder 2 and the anvil cylinder 22, and is wound around a plurality of rolls 14 having their opposite shaft ends pivotably supported from the frames 4*a* and 4*b*. It is to be noted that the width of the above-mentioned belt 12 is made equal to or somewhat broader than that of the knife 1 on the knife cylinder 2, and the arrangement is such that the belt 12 can travel at a predetermined speed (a traveling speed of the corrugated cardboard web 17) by making a gear 15 provided at a shaft end of the roll 14 mesh with a gear 16 fixedly secured to the shaft 8 of the driving motor 9. The surface of the above-mentioned anvil cylinder 22 has a configuration shown in FIGS. 5 and 6 in which a central portion of an elastic body 30 is removed on a part of the circumferential surface. The width of the removed part is successively decreased from a portion S extending over the entire width up to a predetermined dimension $S_o$. A step (a recess and a ridge) is thus formed.

Accordingly, by variably setting the phase relationship between the knife 1 of the knife cylinder 2 and the anvil cylinder 22, two kinds of cutting works become possible, as shown in FIG. 7. More particularly, if the anvil cylinder 22 is engaged with the knife 1 at a position A in FIG. 6, then cutting over the entire width is possible. If the anvil cylinder 22 is engaged with the knife 1 at a position B in the same figure, then at the opposite width end portions of the corrugated cardboard web 17, slits (slots) having a length corresponding to a dimension $P_o$ in FIG. 6 can be formed. It is to be noted that in FIG. 6, the portion corresponding to a dimension P is a recessed portion formed on the cylindrical surface of the anvil cylinder 22. Accordingly, in this interval a pinching force (shearing force) between the knife 1 and the anvil cylinder 22 would not be generated, and so, cutting cannot be done. In addition, by appropriately variably setting the position B where the anvil cylinder 22 is engaged with the knife 1, the rotary shear of the illustrated type can machine slots having an arbitrary length of from zero to a maximum $(W-S_o)/2$ at the opposite width ends of the corrugated cardboard web 17.

The operation of the rotary shear as shown in FIG. 4 will be described as follows. As initial setting of the rotary shear, at first the electromagnetic clutch brake 28 is connected, then the anvil cylinder 22 is rotated by driving the indexing motor 29 and a phase to be engaged with the knife 1 is set (indexed), and under that condition, the brake of the above-mentioned clutch brake 28 is actuated and thereby the anvil cylinder 22 is held at a fixed position.

Subsequently, the phase of the knife 1 is matched to the traveling corrugated cardboard web 17, and the electromagnetic clutch brake 5 is connected. The rotational behavior of the knife cylinder 2 is such that it can be rotated or stopped at a predetermined timing by operating (connecting or disconnecting) the electromagnetic clutch brake 5.

FIG. 9 is a schematic side view of a slitter-scorer positioned in the next stage, and FIG. 8 is a schematic plan view depicted at a position corresponding vertically to FIG. 9 as viewed on the same sheet of drawing for illustrating a machined condition of the corrugated cardboard web. A slitter-scorer illustrated generally by reference numerals Pa and Pb, is an apparatus for machining predetermined score lines K and slitting slots S on a traveling corrugated cardboard web 17 as shown in FIG. 8 by means of equipped scoring rolls 31*a* and 31*b* and slitter knives 32*a* and 32*b*, and by appropriately selecting a corrugated cardboard web width W in relation to a necessitated product sheet width $W_o$. Accordingly, production of a plurality of sheets (multiple sheet production) can be done simultaneously (FIG. 8 illustrates the case of two-sheet production).

In addition, in order to reduce time for resetting necessitated by an order change, two slitter-scorers $P_a$ and $P_b$ are installed and aligned in the traveling direction of the sheets. It is to be noted that the entire width W of the above-described corrugated cardboard web to be produced was set somewhat broader than the width $W_o$ to be used as product sheets, and the opposite width end portions where faults, e.g. displacement upon sticking of the original paper sheets, squeezing-out of paste and the like are liable to occur, are cut in a belt shape, and are sucked into respective trim ducts 33 as trims (broke wastes) 21(*a*)–(*e*) and processed. The rotary shear in the prior art was operated as a trim shear to be used for cutting the tip ends of the trims 21*b* on the side of a new order, which was necessitated mainly upon switching the slitter-scorers P*a* and P*b* according to order change, that is, upon change of processing of the trims 21 which are formed depending upon a width W of the corrugated cardboard web being produced and a width Wo of the product sheets.

Next, changing the setting of a rotary shear in the prior art device is described as follows. A trimming position resulting from an order change is transmitted as a signal from an order change system controller, not shown. Various settings corresponding to a new order are carried out in the slitter-scorer $P_b$, under a stand-by position, besides position setting of a trim duct 33*b*. At the same time, a relative angular position of the anvil cylinder 22 in a trim cutting device (rotary shear) is set with respect to position of the knife 1 so as to set slitting lengths at the opposite width ends of the corrugated cardboard web corresponding to the new order.

Then, the knife cylinder 2 and the elastic body belt 12 are rotated in the opposite directions at a predetermined timing matched with passage of the traveling corrugated cardboard web 17, and trim cutting notches are formed at the desired positions. Next, the above-mentioned notched positions are transferred to the slitter-scorer $P_b$ under a stand-by condition. The scoring rolls 31*b*, set at a predetermined position, are then meshed followed by the meshing of the slitter knives 32*b*, operate on the cardboard web according to the new order. On the other hand, the slitter-scorer $P_a$ works according to the old order. At a predetermined timing, when the leading end of the corrugated cardboard sheet according to the new order arrives, the engagements of the scoring rolls 31*a* and the slitter knives 32*a* are sequentially released. In addition, new trim 21*b* produced from the corrugated cardboard web 17 according to the new order are respectively sucked and conveyed by a pair of newly set trim ducts 33*b*, and are processed after they have been shredded by a cutter-blower 34 provided in the passageway.

The rotary shear in the prior art was constructed and operated in the above-described manner, and it had only two kinds of functions: slitting by an arbitrary length at the opposite width ends of a traveling corrugated cardboard web; or perfectly cutting the web over its entire width. Accordingly, in the setting for two-sheet production as shown in FIG. 8, a specification can be switched stably only under a limited condition such that only a trim width at the width ends is changed as a result of order change. In other words, a sheet separating slit slot has a continuous shape, and even if a sheet separating slit slot should become discontinuous as a result of change of a sheet width, cut lengths of the two sheets traveling in parallel are the same, or that only one kind of sheets are produced from a single web, though not shown.

However, in the case of changing a specification according to an order change, it occurs frequently that not only dimensions in the widthwise direction of sheets 20 are changed, but also cut lengths LT and LD of two sheets traveling in parallel are also arbitrarily changed as shown in FIG. 3. In two-sheet production for producing two kinds of sheets in parallel from a single corrugated cardboard sheet, as in the case where cut lengths of the sheets traveling in parallel are different from each other, a traveling route of a sheet on one side would be changed to be transferred respectively to different rotary drum shears 35*a* and 35*b* and cut into predetermined lengths at a cut-off D in the downstream stage. Accordingly, in the case where a specification has been changed, for example, as illustrated in FIG. 3, a discontinuous portion X would remain in the central slitting slot, and so, upon change of the traveling route (separation to upper and lower routes) at the cut-off D in the downstream stage in which is executed in the case where the lengths of the above-mentioned sheets traveling in parallel are different from each other, troubles would frequently occur such that not only the above-mentioned discontinuous portion is broken and becomes unacceptable paper sheets, but also the broken pieces of paper sheets are caught by downstream conveyor means (feed rolls) resulting in jam-up.

For the above-mentioned reasons, in the heretofore known rotary shear, in the case where the position of the sheet separating slitting slot is changed, upon order change, the method was employed of once cutting and separating the front and rear corrugated cardboard webs over the entire width and thereby avoiding damage to the sheets occurring at the above-mentioned discontinuous portion X. However, this method has the shortcoming in that restriction of the trailing end of the old order sheet and the leading end of the new order sheet would become free temporarily resulting in a zig-zag motion of the sheets 20 and variation of a conveying speed would arise. Consequently, the precision of the cutting length and the like would become unreliable, and it would become a principal cause of various troubles which may arise during the period before the sheet traveling condition becomes stable.

In summary, the above-described rotary shear in the prior art could perform only two kinds of cutting work: of machining slots in the widthwise direction of a sheet at the opposite width ends of a corrugated cardboard web; or perfectly cutting the web over the entire width of the sheet. Accordingly, the rotary shear was stable with stably under a limited condition such as where only trim widths are changed according to an order change. However, in multiple-sheet production, for instance, two kinds (a plurality of kinds) of sheets from a single corrugated cardboard sheet are created such as where widths of the sheets are changed as a result of order change and also where cut sheet lengths are different. There was a disadvantage with this operation in that at the changing point between the new and old orders, the slitting position would be displaced in the widthwise direction of the sheet, resulting in a discontinuous portion. Hence, the sheets would broken due to separation of the sheet traveling routes to the upper and lower routes at the cut-off in the subsequent stage, creating unacceptable paper sheets. Furthermore, it became a principal cause of various problems such as where broken pieces of the paper sheets would block the gap between conveyor rolls in the subsequent stage and result in jam-up or the like.

In addition, problems would result where the sheet is perfectly cut in the widthwise direction at the portion of the order change. As a counter-measure for the above-mentioned problem, although the disadvantages of breaking at the slitting portion and the like are eliminated, the trailing end of the old order sheet and the leading end of the new order sheet would become free, and the conveying condition would become unstable. Consequently, problems would arise resulting from the occurrence of zig-zag traveling or a traveling speed (length) variations, resulting in deterioration of precision in a cut length at the cut-off in the subsequent stage.

SUMMARY OF THE INVENTION

It is therefore one object of the present invention to provide an improved rotary shear which is free from the above-mentioned shortcomings of the rotary shear in the prior art.

A more specific object of the present invention is to provide a rotary shear which can smoothly follow order change without necessitating perfectly cutting a web over its entire width, even in the case where two or more kinds of sheets having different cut lengths are produced from a single web.

Another specific object of the present invention is to provide a rotary shear, which will eliminate deterioration of precision in a cut length caused by unstability of traveling of sheets upon order change, can be eliminated.

According to one feature of the present invention, there is provided a rotary shear for performing slotting work or cutting work upon a corrugated cardboard web produced continuously by a corrugating machine nearly at right angles to the traveling direction of the corrugated cardboard web, which comprises a knife cylinder having a knife fixedly secured thereto over nearly the entire width of the outer circumferential surface of the cylinder. The invention further includes a pressing means divided into a plurality of sections along the widthwise direction of the corrugated cardboard web which is constructed in such manner that the respective sections can be individually raised and lowered, and an endless elastic body belt driven to travel at a predetermined timing with respect to the traveling corrugated cardboard web.

According to the present invention, in the case where dimensions of trim widths at the opposite side edges of a corrugated cardboard web have been changed according to order change, or in the case where sheet widths are changed in a multiple-sheet production for producing a plurality of kinds of sheets having different cut lengths, the above-described disadvantages in the prior art are eliminated since slitting slots in the widthwise direction of the sheet can be formed only at necessary portions, even if the new and old sheets are not separated perfectly according to order change as is the case with the prior art. Accordingly, the sheets can be conveyed stably, and also, troubles such as jam-up or the like can be eliminated.

The above-mentioned and other objects, features and advantages of the present invention will become more apparent by reference to the following description of one preferred embodiment of the invention taken in conjunction with the accompanying drawings.

BRIEF DESCRIPTION OF THE DRAWINGS

In the accompanying drawings:

FIG. 1(*b*) is a vertical cross-section view taken along line E—E in FIG. 1(*a*) as viewed in the direction of arrows;

FIG. 4(*b*) is a cross-section view taken along line F—F in FIG. 4(*a*) as viewed in the direction of arrows;

DESCRIPTION OF THE PREFERRED EMBODIMENT

Now the present invention will be described in more detail in connection to a preferred embodiment illustrated in FIGS. 1 and 2. At first, a construction and an operation of a rotary shear according to one preferred embodiment of the invention will be explained with reference to FIGS. 1 and 2.

Figure 1A:
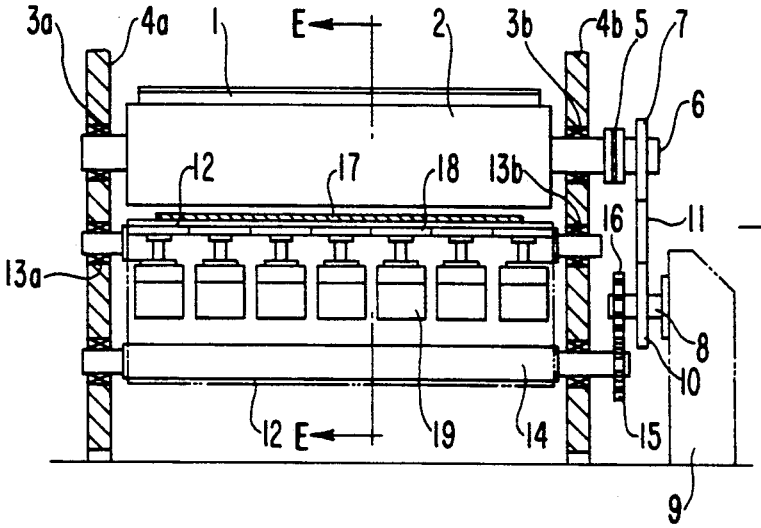
FIG. 1(*a*) is a cross-section front view of one preferred embodiment of a rotary shear according to the present invention.
Figure 1B:
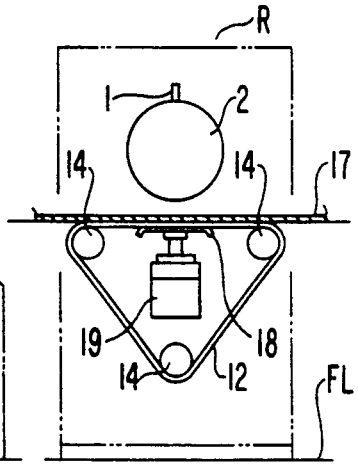
Figure 2:
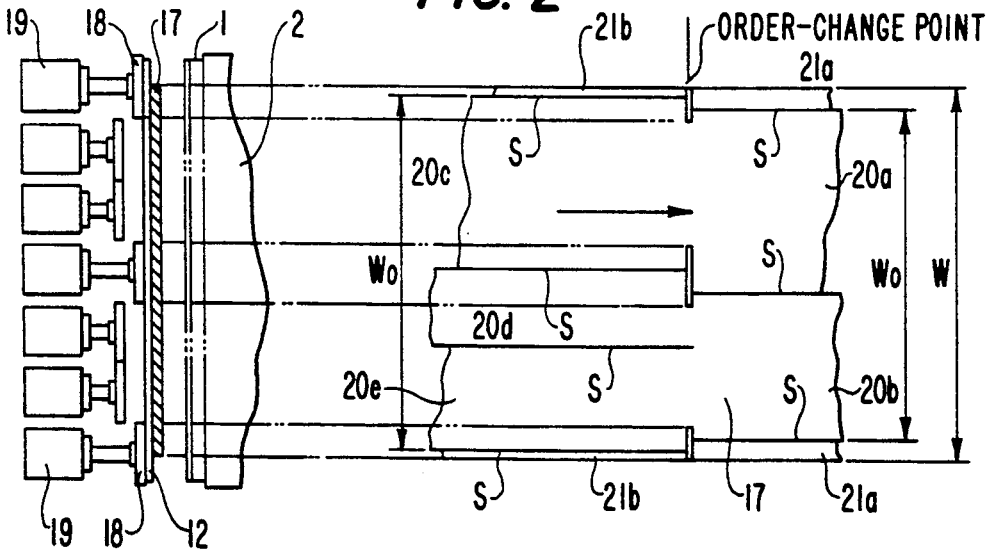
FIG. 2 is a schematic view to be referred to for explaining a machining condition of a corrugated cardboard sheet.
Figure 3:
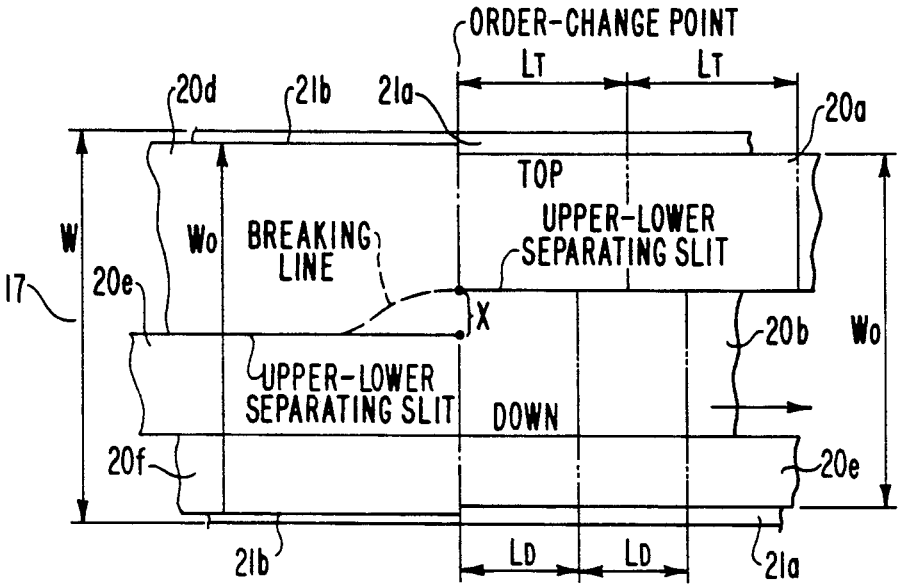
FIG. 3 is a schematic view to be referred to for explaining disadvantages of a rotary shear of the heretofore known type.
Figure 4A:
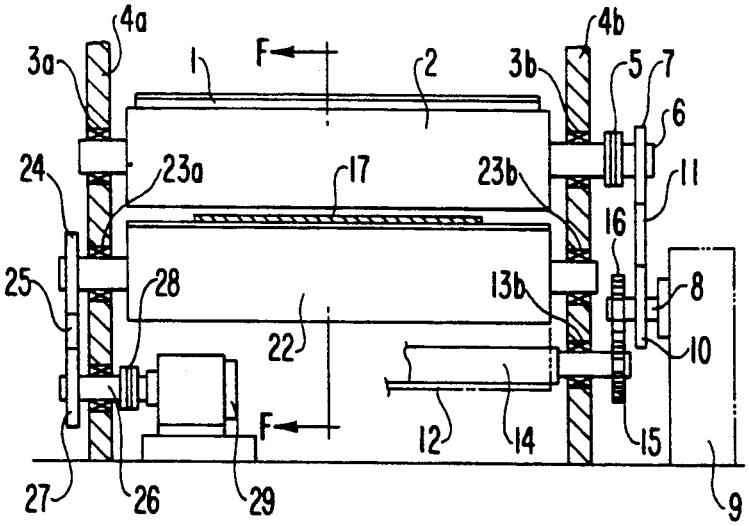
FIG. 4(a) (PRIOR ART)
FIG. 4(*a*) is a cross-section front view of a rotary shear in the prior art.
Figure 4B:
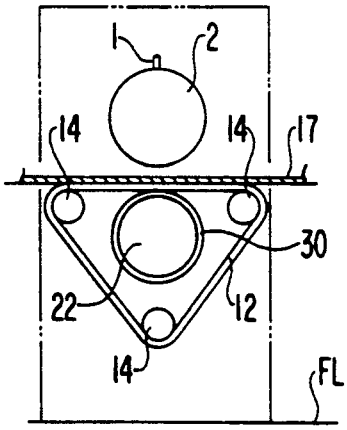
FIG. 4(b) (PRIOR ART)
Figure 5:
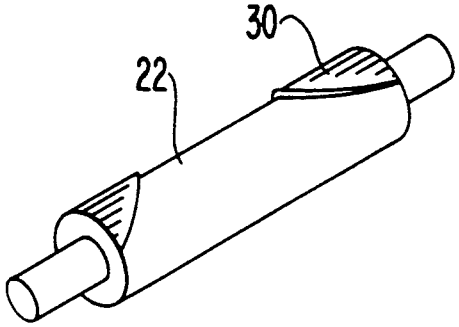
FIG. 5 (PRIOR ART)
FIG. 5 is a perspective view of an anvil cylinder in the prior art.
Figure 6:
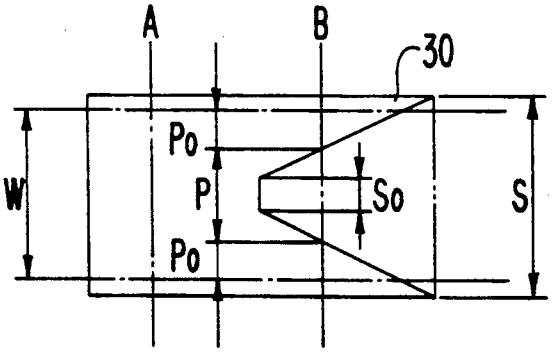
FIG. 6 (PRIOR ART)
FIG. 6 is a developed view of an outer circumferential surface of the same anvil cylinder.
Figure 7:
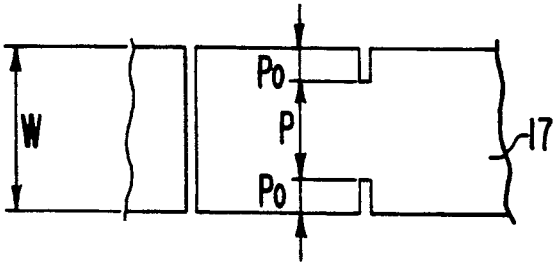
FIG. 7 (PRIOR ART)
FIG. 7 is a schematic view to be referred to for explaining a machining condition of a corrugated cardboard sheet as depicted at the position corresponding to FIG. 6.
Figure 8:
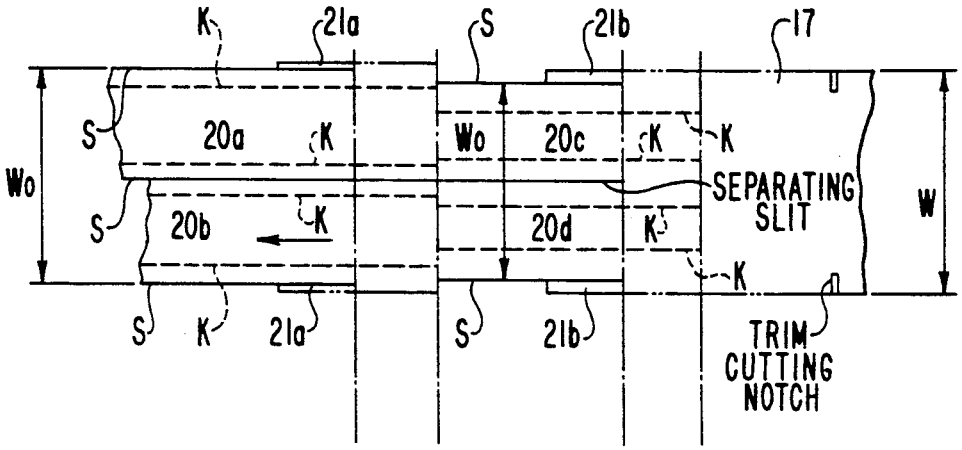
FIG. 8 is a schematic view showing a scoring and cutting condition on a corrugated cardboard sheet.
Figure 9:
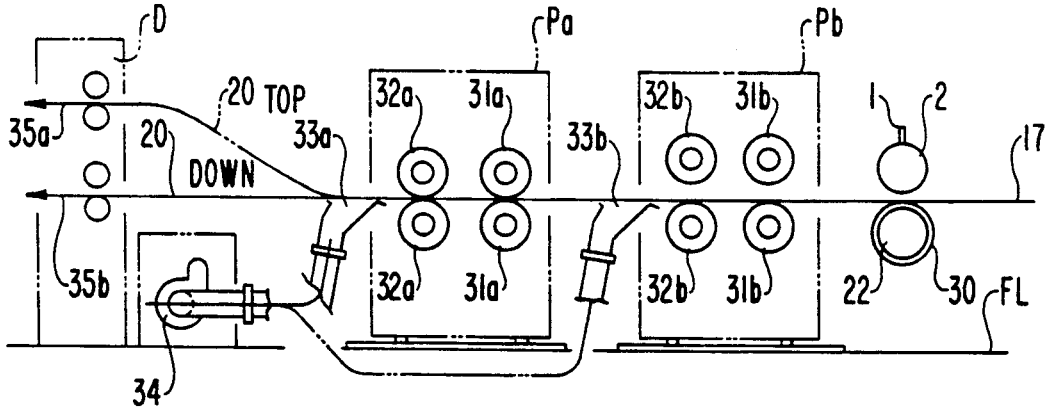
FIG. 9 is a schematic view showing a machining process of a corrugated cardboard sheet and a traveling route of a corrugated cardboard sheet.

As shown in FIG. 1, a knife cylinder 2 having a knife 1 fixedly secured thereto has its opposite ends pivotably supported from frames 4*a* and 4*b* erected at the opposite side edge of the apparatus via bearings 3*a* and 3*b*, and to the outermost end on one side thereof is connected a shaft 6 via an electromagnetic clutch brake 5. In addition, to the same shaft 6 is mounted a pulley 7, and this pulley 7 is coupled to a pulley 10 fixedly secured to a line shaft not shown or a shaft 8 of a motor 9 serving as an independent drive unit by means of an endless synchronizing belt 11 wound therearound. On the other hand, an endless elastic body belt 12 is wound around a plurality of rolls 14 disposed in parallel to the above-mentioned knife cylinder 2 and having the opposite ends of their shafts pivotably supported from the frames 4*a* and 4*b* via bearings 13*a* and 13*b*, respectively. The width of the elastic body belt 12 is made equal to or somewhat broader than the knife 1 on the knife cylinder 2, and the belt 12 is constructed so as to be able to travel at a predetermined speed (a traveling speed of the corrugated cardboard web 17) by meshing a gear 15 fixedly secured to one end of the shaft of the roll 14 with a gear 16 mounted to the above-described line shaft or the shaft 8 of the driving motor 9. In these figures, reference numeral 18 designates a pressing means in which respective sections are divided along the widthwise direction of the corrugated cardboard web 17 which can be individually raised or lowered by an expansion/contraction operation of cylinders 19, such as hydraulic cylinders fixedly secured to the bottom surfaces of the sections.

The operation of the rotary shear according to the present invention will be explained as follows. The rotary shear is initially set, for example as shown in FIG. 2, to correspond to slots in the widthwise direction of the corrugated cardboard web which becomes necessary as a result of displacement of the position of the upper-lower separating slitting slot in the traveling direction of the sheet according to order change, predetermined cylinders 19 are projected (raised) for setting, thereby the sections of the pressing means 18 fixedly secured to the cylinder heads are raised and brought into sliding contact with the underside of the traveling elastic body belt 12. It is to be noted that the sections of the pressing means 18 at the location where the cutting slot is not necessitated are held in a stand-by state at the lowered position.

Next, if the electromagnetic clutch brake 5 is operated so as to match the phase of the knife 1 with respect to the traveling corrugated cardboard web 17, slots having predetermined lengths can be machined at desired positions. More particularly, a pinching and cutting force of the knife 1 acts on the corrugated cardboard web 17 traveling between the elastic body belt 12 and the knife cylinder 2 only at the portion (width portion) where the pressing means 18 has been raised and set. Further, at the portion where the pressing means 18 is set at the lowered position, a cutting force would not act due to deformation (escape) of the elastic body belt 12. Accordingly, the corrugated cardboard web 17 is held in a state where slots in the widthwise direction are formed only at necessary portions, and is conveyed to the downstream stage as continuous corrugated cardboard sheets 20 as a whole. It is to be noted that if all the cylinders 19 corresponding to the width of the corrugated cardboard web 17 are actuated so as to press and all the pressing plates 18 are raised and set as shown in FIG. 1, then perfect cutting over the entire region in the widthwise direction is also possible, and the apparatus can quickly respond to an unexpectable accident such as production of unacceptable paper sheets.

With regard to the control method for the elastic body belt 12, the method illustrated in FIG. 1(*a*) is of such type that the shaft 8 and the rolls 14 are directly coupled via the gears 15 and 16 and the belt 12 are made to always rotationally travel. Various other methods can be conceived such that the belt 12 may be driven to travel only just before and after the time for cutting by assembling a clutch, not shown, between the shaft 8 and the roll 14. Also, the raising and lowering means for the pressing means 18 should not be limited to the illustrated cylinders 19.

As will be apparent from the above description of the preferred embodiment, since the present invention has structural and functional features as described above, the slitting slots in the widthwise direction of the sheets which become necessary upon order change can be formed at arbitrary positions, and even in the case where two or more kinds of sheets having different cutting lengths are produced from a single corrugated cardboard sheet, smooth order change can be achieved even if the web is not perfectly cut over the entire region in the widthwise direction as is the case with the prior art. In addition, owing to the fact that the new and old sheets are not separated, jam-up in the next stage which may possibly occur upon high-speed order change or upon order change for a fragile sheet, can be eliminated, and also zig-zag traveling of the trailing end of the old sheet and the leading end of the new sheet caused by cutting over the entire width upon order change, can be eliminated. Furthermore, upon order change, poor precision in cut length caused by unstability (uncertainty) of traveling of a sheet can be obviated.

While a principle of the present invention has been described above in connection to one preferred embodiment of the invention, it is intended that all matter contained in the above description and illustrated in the accompanying drawings shall be interpreted to be illustrative and not in a limiting sense.

What is claimed is:

1. A rotary shear for performing slotting work or cutting work upon a corrugated cardboard web, produced continuously by a corrugating machine, at nearly right angles to a direction of travel of said corrugated cardboard web, said rotary shear comprising:

(a) means for moving said corrugated cardboard web through said rotary shear in the direction of travel;

(b) a cutting means for cutting at least a portion of said corrugated cardboard web, at least at right angles to the direction of travel; and (c) a pressing means for enabling at least a portion of said corrugated cardboard to be cut by said cutting means, said pressing means comprising a plurality of pressing sections mounted in a direction of the width of said corrugated cardboard, said pressing means further comprises means for moving said pressing sections at least in a raised position and in a lowered positioned, wherein said corrugated cardboard web is cut, at least at right angles to the direction of travel, by said cutting means only when any of said pressing sections is moved to a raised position by said pressing means.

2. A rotary shear as claimed in claim 1, wherein said pressing means is supported by a plurality of expansible cylinders arranged along the widthwise direction of the corrugated cardboard web.

3. The rotary shear as claimed in claim 1, wherein said cutting means comprises a knife cylinder having an outer surface, said knife cylinder further having a knife fixedly secured thereto over at least a substantial portion of the width of said outer surface in a longitudinal direction of the cylinder.

4. The rotary shear as claimed in claim 1, wherein said means for moving comprises an endless elastic body belt driven at a predetermined rate relative to the rate of travel of said corrugated cardboard web.

5. A rotary shear for performing slotting work or cutting work upon a corrugated cardboard web, produced continuously by a corrugating machine, at nearly right angles to a direction of travel of said corrugated cardboard web, said rotary shear comprising:

(a) a cutting means for cutting at least a portion of said corrugated cardboard web, at least at right angles to the direction of travel; and (b) a pressing means for enabling at least a portion of said corrugated cardboard to be cut by said cutting means, said pressing means comprising a plurality of pressing sections mounted in a direction of the width of said corrugated cardboard, said pressing means further comprises means for moving said pressing sections at least in a raised position and in a lowered positioned, wherein said corrugated cardboard web is cut, at least at right angles to the direction of travel, by said cutting means only when any of said pressing sections is moved to a raised position by said pressing means.

* * * * *

UNITED STATES PATENT AND TRADEMARK OFFICE

CERTIFICATE OF CORRECTION

PATENT NO. : 5,152,205

DATED : October 6, 1992

INVENTOR(S) : Yoshida et al.

It is certified that error appears in the above-identified patent and that said Letters Patent is hereby corrected as shown below:

Column 1, line 38, after "24", insert --,--.

Column 2, line 41, after "slitter-scorer", insert --,--.

Column 4, line 3, after "stage", delete "in", and insert --,--.

Column 4, line 30, delete "of", first occurrence.

Column 5, line 10, after "shear", delete the ",".

Signed and Sealed this

Twenty-sixth Day of April, 1994

*Attest:*

Bruce Lehman

BRUCE LEHMAN

*Attesting Officer*

*Commissioner of Patents and Trademarks*